US005763986A

United States Patent [19]

Nakanishi et al.

[11] Patent Number: 5,763,986

[45] Date of Patent: Jun. 9, 1998

[54] CYCLOTRON AND METHOD OF ADJUSTING THE SAME HAVING AN ION PULLER ELECTRODE WITH A MOVABLE APERTURE

[75] Inventors: Noriyoshi Nakanishi, Saitama-ken; Shuichiro Wakase, Hokkaido, both of Japan

[73] Assignees: The Institute of Physical and Chemical Research, Wako; Ion Kasokuki Kabushiki Kaisha, Hakodate, both of Japan

[21] Appl. No.: 733,269

[22] Filed: Oct. 17, 1996

[30] Foreign Application Priority Data

Oct. 17, 1995 [JP] Japan ..... 7-311713

[51] Int. Cl.[6] ..... H05H 13/00; H01J 23/00

[52] U.S. Cl. ..... 313/62; 315/502; 315/507

[58] Field of Search ..... 313/62, 153, 359.1; 315/502, 507; 376/112

[56] References Cited

U.S. PATENT DOCUMENTS

| | | | |
|---|---|---|---|
| 4,139,777 | 2/1979 | Rautenbach | 376/112 |
| 4,146,811 | 3/1979 | Tran et al. | 313/62 |
| 5,416,440 | 5/1995 | Lyons et al. | 315/502 |

OTHER PUBLICATIONS

Database WPI Section E1, Week 9512 Derwent Publications Ltd., JP07014534A (Nisshin Electrical Co Ltd), Jan. 17, 1995.

1975 Particle Accelerator Conference, Washington, D.C., Mar. 12–14, 1995, vol. 22, No. 3, Mallory et al, "A rotatable cold cathode Penning ion source", pp. 1669–1671, Jun. 1975.

*Primary Examiner*—Sandra L. O'Shea
*Assistant Examiner*—Joseph Williams
*Attorney, Agent, or Firm*—Jacobson, Price, Holman & Stern, PLLC

[57] ABSTRACT

A cyclotron comprises a dee, an ion source cone provided with an ion outlet through which ions are emitted, and an ion puller electrode mounted on the dee to pull out ions from the ion source cone through the ion outlet by applying a voltage between the ion source and the ion puller electrode. The ion source cone can be moved from outside the cyclotron without breaking the vacuum of the cyclotron. The ion puller electrode has a sliding aperture member provided with an aperture and capable of being moved relative to the dee. An operating projection of the ion source cone is brought into engagement with the aperture member, and then the ion source cone is moved to move the aperture member to a desired position. Thus, the aperture of the ion puller electrode can be positioned at an appropriate position opposite the ion outlet by moving the ion source cone without requiring any special mechanism for moving the ion puller electrode.

6 Claims, 4 Drawing Sheets

CYCLOTRON AND METHOD OF ADJUSTING THE SAME HAVING AN ION PULLER ELECTRODE WITH A MOVABLE APERTURE

BACKGROUND OF THE INVENTION

1. Field of the Invention

The present invention relates to a cyclotron and a method of adjusting the same and, more particularly, to a cyclotron having an ion puller electrode having an aperture capable of being moved to a desired position, and a method of adjusting such a cyclotron.

2. Description of the Related Art

A conventional cyclotron has a dee, an ion source cone having an ion outlet through which ions are emitted, and an ion puller electrode attached to the dee to pull out ions through the ion outlet by applying a voltage across the ion source and the ion puller electrode. The ion puller electrode has an aperture facing the ion outlet of the ion source cone. Ions emitted from the ion source cone travel through the aperture into the ion puller electrode.

The aperture of the ion puller electrode of the conventional cyclotron is fixed and different ion puller electrodes must be used for different kinds of ions.

SUMMARY OF THE INVENTION

The present invention has been made in view of the trouble of changing the ion puller electrode and it is therefore an object of the present invention to provide a cyclotron provided with an ion puller electrode having an aperture capable of being moved to a desired position, and a method of adjusting the cyclotron.

According to a first aspect of the present invention, a cyclotron comprises a dee, an ion source cone having an ion outlet through which ions are emitted, and an ion puller electrode mounted on the dee to pull out ions from the ion source cone through the ion outlet by applying a voltage between the ion source cone and the ion puller electrode. The ion puller electrode has a sliding aperture member provided with an aperture which can be positioned opposite to the ion outlet of the ion source cone and capable of sliding relative to the dee, and the ion source cone can be in contact with the aperture member and move in a sliding direction of the aperture member.

According to a second aspect of the present invention, a method of adjusting a cyclotron comprising a dee, an ion source cone having an ion outlet through which ions are emitted, and an ion puller electrode to pull out ions through the ion outlet by applying a voltage between the ion source and the ion puller electrode, the ion puller electrode having a sliding aperture member provided with an aperture which can be positioned opposite to the ion outlet of the ion source cone and capable of sliding relative to the dee, the ion source cone being in contact with the aperture member and being movable in a sliding direction of the sliding member, comprises steps of bringing the ion source cone into contact with the aperture member, moving the ion source cone until the aperture member slides on the dee to a desired position, and moving the ion source cone to a position where the ion outlet of the ion source cone is opposite to the aperture of the aperture member.

According to the present invention, the aperture of the ion puller electrode is positioned properly relative to the ion outlet of the appropriate known ion source cone, and then the ion source cone is disposed at an appropriate position.

Since the ion source cone can be moved from outside without breaking the vacuum of the cyclotron, the aperture member of the ion puller electrode, similarly to the ion source cone, can be operated for movement from outside without breaking the vacuum of the cyclotron. The positions of the ion source cone and the ion puller electrode relative to each other can readily be adjusted by a generally known ion source cone moving mechanism without requiring any additional ion puller electrode moving mechanism. Since the aperture member of the ion puller electrode can be moved, the longitudinal width of the aperture can be reduced to the least necessary extent and the aperture can be located in a range without deteriorating the parallelism and perpendicularity to an opposite surface of lines of electric force, so that the first ion acceleration cycle can satisfactorily be achieved.

The above and other objects, features and advantages of the present invention will become more apparent from the following description taken in connection with the accompanying drawings.

DETAILED DESCRIPTION OF THE PREFERRED EMBODIMENTS

General principle of a cyclotron will be explained with reference to FIGS. 4 to 7 prior to the description of the preferred embodiments of the present invention.

A cyclotron comprises a dee 23, an ion source cone 22 provided with an ion outlet 22*a*, and an ion puller electrode (hereinafter referred to simply as "puller") 21 provided with an ion pulling aperture 21*a*. The puller 21 is fixed to the dee 23 with its ion pulling aperture 21*a* positioned opposite to the ion outlet 22*a*. A high-frequency voltage of the same phase and the same frequency is applied between the ion source cone 22 and the puller 21 to pull out ions produced in the plasma chamber 22*b* of the ion source cone 22 through the ion outlet 22*a* by an electric force toward the puller 21 as indicated by the arrow A. It is desirable that lines B of electric force (FIG. 7) extending between a flat surface 22*c* formed on the ion source cone 22 and a surface 21*b* of the puller 21 facing the flat surface 22*c* are parallel to each other. The cyclotron accelerates ions of various elements. Since ions of different elements have different masses and different charges, respectively, appropriate acceleration voltage, appropriate ion starting position (the position of the ion outlet 22*a*) and appropriate position of the ion source cone 22 relative to the puller 21 are dependent on the mass of ions. Therefore, an appropriate acceleration voltage and an appropriate position of the ion outlet 22*a* of the ion source cone 22 relative to the puller 21 must be determined for every kind of ions to be accelerated. If the ion outlet 22*a* is positioned inappropriately relative to the puller 21, the continuous acceleration of the ions become impossible due to the distortion of the orbit path of the accelerated ions in several turns of the ions and acceleration phase shift or the ions disperse in the axial direction of the magnetic pole or disappear. Therefore, only the ion source cone 22 is designed so that the ion source cone 22 can be moved from outside without braking the vacuum of the cyclotron, and the ion pulling aperture 21*a* of the puller 21 is formed in a large area to cope with the movement of the ion source cone 22.

Figure 7:
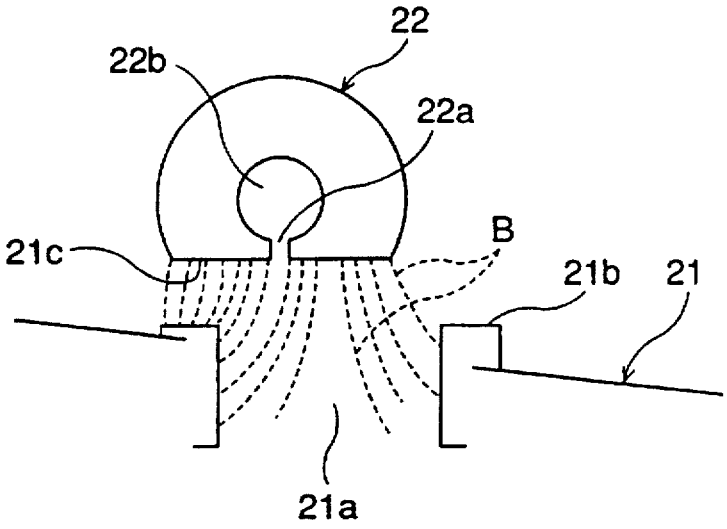
FIG.7 (PRIOR ART)
FIG. 7 is a plan view of an ion pulling unit included in a cyclotron.

The puller 21 of the general cyclotron cannot be moved to an optional position by an external remote operation. The cyclotron needs to be dismantled of the main electromagnet to expose the dee 23 every time the position of the puller 21 needs to be changed. Such work for changing the position of the puller 21 require inevitably breaking the vacuum of the cyclotron, which is quite unfavorable to the maintenance of the cyclotron in normal condition. If the ion pulling aperture 21*a* of the puller 21 is formed in a large area to cope with the movement of the ion source cone 22, the parallelism of the lines B of electric force and the perpendicularity of the same to the end surface 21*b* of the puller 21 are deteriorated as shown in FIG. 7, very adversely affecting the first ion acceleration cycle.

Figure 1:
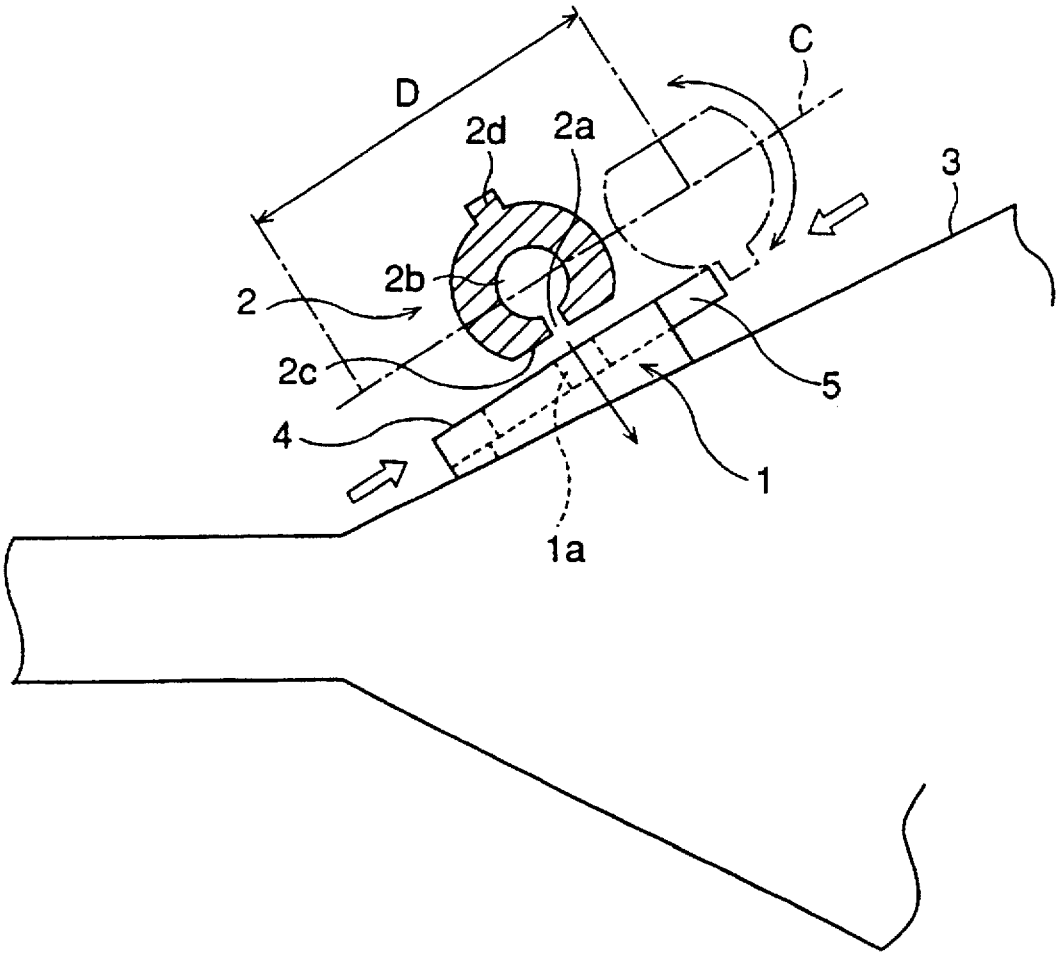
FIG. 1 is a schematic plan view of an ion pulling unit included in a cyclotron in a preferred embodiment according to the present invention.

Now, a preferred embodiment of the present invention will be described with reference to the accompanying drawings. FIG. 1 is a schematic plan view of an ion pulling unit included in a cyclotron in a preferred embodiment according to the present invention, FIG. 2 is a front view of an ion puller electrode included in the cyclotron of the present invention and FIG. 3 is a fragmentary sectional view taken on line III—III in FIG. 2.

Figure 2:
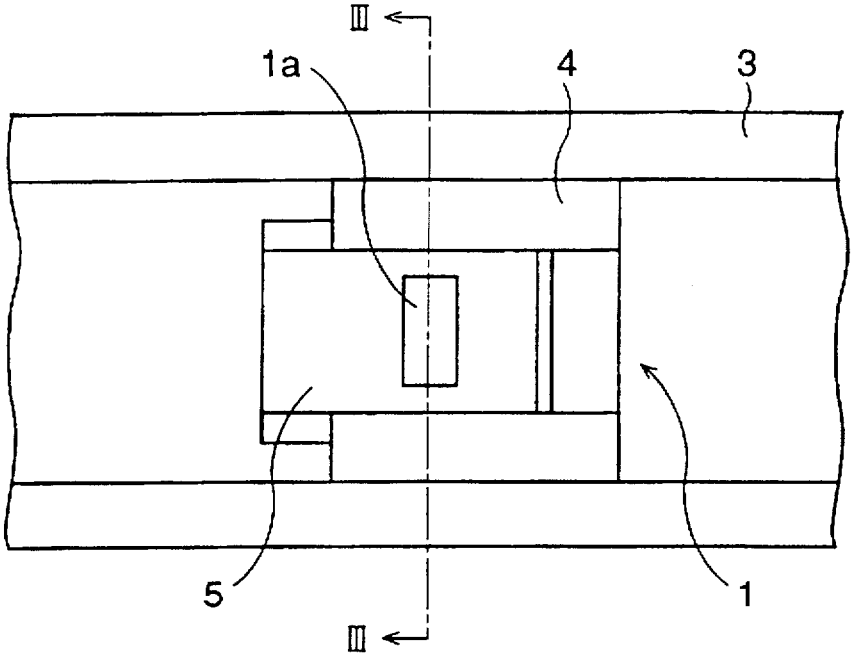
FIG. 2 is a front view of an ion puller electrode included in the cyclotron of the present invention.
Figure 3:
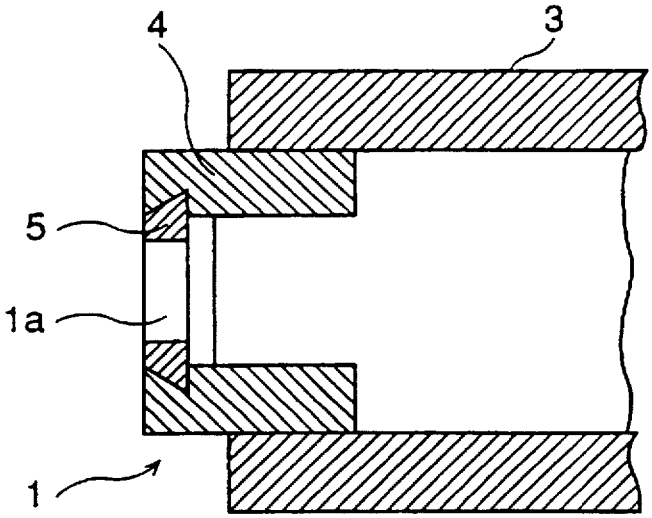
FIG. 3 is a fragmentary sectional view taken on line III—III in FIG. 2.
Figure 4:
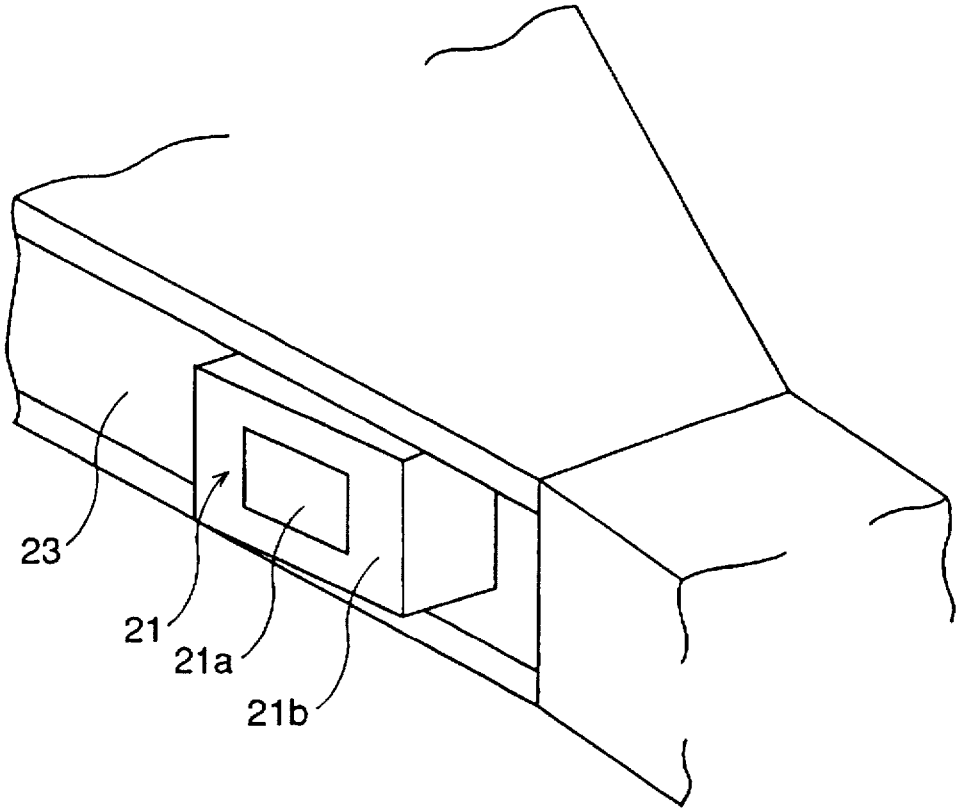
FIG.4 (PRIOR ART)
FIG. 4 is a perspective view of an ion pulling unit included in a known cyclotron.
Figure 5:
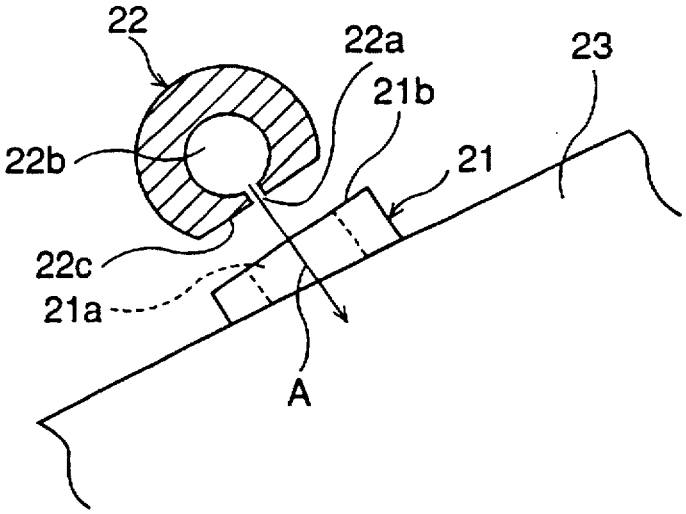
FIG.5 (PRIOR ART)
FIG. 5 is a plan view of an ion pulling unit included in a cyclotron.
Figure 6:
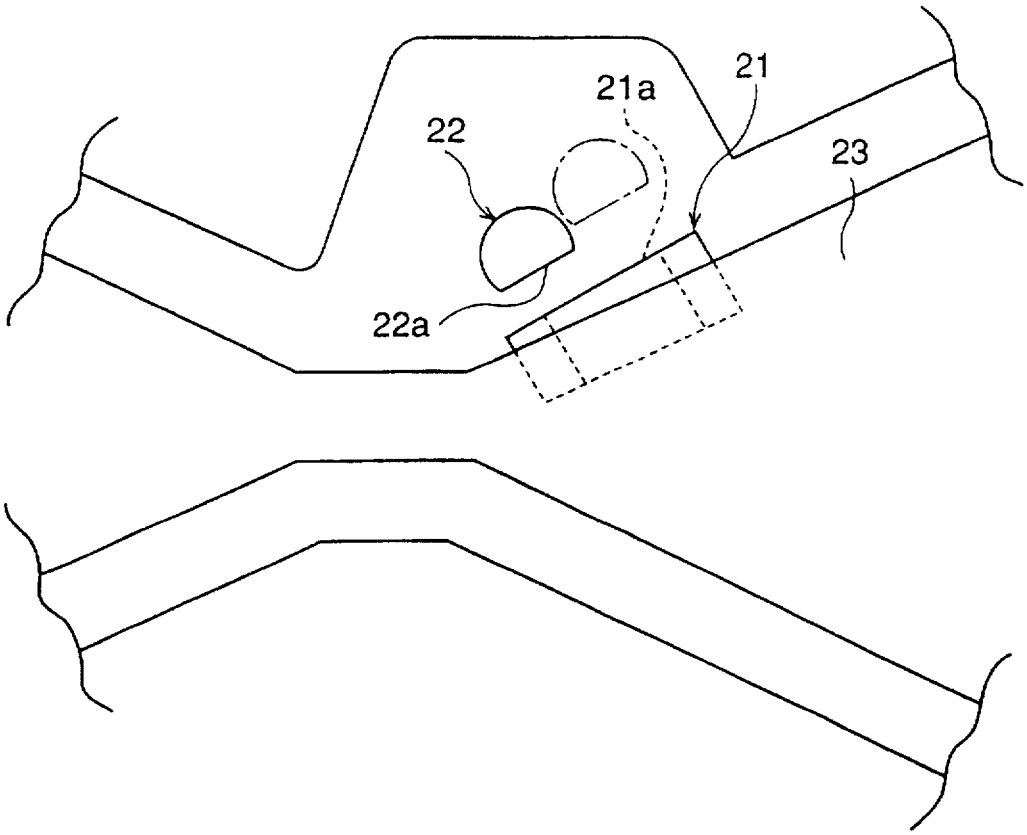
FIG.6 (PRIOR ART)
FIG. 6 is a plan view of an ion pulling unit included in a cyclotron.

Referring to FIGS. 1 to 3, a cyclotron comprises a dee 3, an ion source cone 2 provided with an ion outlet 2*a*, and an ion puller electrode (puller) 1 provided with an ion pulling aperture 1*a*. The puller 1 is mounted on the dee 3 with its ion pulling aperture 1*a* facing to the ion outlet 2*a* of the ion source cone 2. The relatively narrow width of the ion pulling aperture 1*a* corresponds to a range in which the parallelism and the perpendicularity to a corresponding surface of the puller 1 of lines of electric force are not broken.

The puller 1 has a rectangular frame 4, and a plate-shaped aperture member 5 provided with the aperture 1*a* in its central portion and slidably mounted on the frame 4. Thus, the position of the aperture 1*a* of the puller 1 can be changed by sliding the aperture member 5.

The ion source cone 2 is movable at least along a line C in a range D and turnable about its axis. The ion source cone 2 can be moved and turned without breaking the vacuum of the cyclotron from outside the vacuum environment of the cyclotron. The ion source cone 2 is similar in this respect to general ion source cones shown in FIGS. 4–7, and hence the description of an ion source cone support structure for supporting the ion source cone 2 will be omitted. The ion source cone 2 has an ion outlet 2*a*, a plasma chamber 2*b*, a flat surface 2*c*, and an operating projection 2*d* projecting from a side opposite a side on which the ion outlet 2*a* is formed. The ion source cone 2 can be turned between an operational position indicated by continuous lines in FIG. 1 where the ion outlet 2*a* is disposed opposite to the aperture member 5 and an unoperational position indicated by imaginary lines in FIG. 1 where the operating projection 2*d* is in contact with an end surface of the aperture member 5. When the ion source cone 2 is moved along the C with the operating projection 2*d* in contact with an end surface of the aperture member 5, the operating projection 2*d* pushes the aperture member 5 to move the aperture member 5 to a desired position.

When accelerating ions an element by the cyclotron of the present invention, the ion source cone 2 is positioned at an appropriate position specific to the ions of the element relative to the puller 1. When setting the ion source cone 2 at the appropriate position, necessary operations are carried out outside the vacuum environment of the cyclotron to move the ion source cone 2. The ion source cone 2 is turned and moved in the range D along the line C for positional adjustment.

When the aperture member 5 of the puller 1 needs to be moved for positional adjustment, the ion source cone 2 is moved to one end of the aperture member 5, the ion source cone 2 is turned about its axis toward the aperture member 5 to bring the operating projection 2*d* into contact with one end of the aperture member 5, and then the ion source cone 2 is moved along the line C, pushing the aperture member 5 to move the aperture member 5 to a desired position. An appropriate position of the ion source cone 2 is dependent on the ions of an element to be accelerated and is known beforehand. Therefore, the aperture member 5 is moved so that the ion pulling aperture 1*a* of the puller 1 is located at a position corresponding to the appropriate position of the ion outlet 2*a* of the ion source cone 2. Since the ion source cone 2 can be moved by an external moving operation without breaking the vacuum of the cyclotron, the aperture member 5 of the puller 1 can be moved by an external moving operation without breaking the vacuum. Since the aperture member 5 provided with the aperture 1*a* of the puller 1 can be moved, the aperture 1*a* may be of the least necessary width. Consequently, the parallelism and perpendicularity to the puller 1 of the lines of electric force extending between the ion source cone 2 and the puller 1 can be secured, the aperture 1*a* can be placed at an optimum position for the first ion acceleration cycle and the first ion acceleration cycle can satisfactorily be accomplished.

The present invention is not limited in its practical application to the embodiment illustrated herein. For example, the operating projection 2*d* need not necessarily be formed on the side opposite the side on which the ion outlet 2*a* is formed, and may be formed in any shape provided that the operating projection can be brought into engagement with the aperture member 5. The aperture plate 5 need not necessarily be formed in the shape of a plate and may be supported on the frame 4 by any suitable one of known mounting structures.

As is apparent from the foregoing description, according to the present invention, the ion source cone 2 having the ion outlet 2*a* is supported so as to be operated for movement from outside the cyclotron, the aperture member 5 having the aperture 1*a* is mounted on the puller 1 so as to be movable, the ion source cone 2 is provided with the operating projection 2*d*, and the operating projection 2*d* can be brought into contact with the aperture member 5 to move the aperture member 5 together with the ion source cone 2. Accordingly, the position of the aperture 1*a* of the puller 1 can be changed by moving the ion source cone 2 to locate the aperture 1*a* at an optimum position corresponding to a position of the ion source cone 2 dependent on ions of an element to be accelerated and hence the first ion acceleration cycle of the cyclotron can satisfactorily be accomplished. Since any special remote control mechanism for operating the puller 1 is not necessary, the present invention does not increase the size, weight and cost of the cyclotron.

What is claimed is:

1. A cyclotron comprising:

a dee;

an ion source cone having an ion outlet through which ions are emitted; and an ion puller electrode mounted on the dee to pull out ions from the ion source cone through the ion outlet by applying a voltage between the ion source and the ion puller electrode;

wherein the ion puller electrode has a sliding aperture member provided with an aperture which can be positioned opposite to the ion outlet of the ion source cone and capable of being moved relative to the dee, and the ion source cone can be in contact with the aperture member and move in a sliding direction of the aperture member.

2. The cyclotron according to claim 1, wherein the ion puller electrode has a frame fixed to the dee, and the sliding aperture member provided with the aperture is supported on the frame for sliding movement relative to the frame.

3. The cyclotron according to claim 1, wherein the ion source cone is provided with an operating projection capable of being brought into engagement with the sliding aperture member.

4. The cyclotron according to claim 2, wherein the ion source cone is turnable about its axis, and the operating projection of the ion source cone is formed on a side opposite a side on which the ion outlet is formed.

5. The cyclotron according to claim 4, wherein the ion source cone can be turned about its axis between a position where the operating projection is on the side of the aperture member and a position where the ion outlet is on the side of the aperture member.

6. A method of adjusting a cyclotron comprising a dee, an ion source cone having an ion outlet through which ions are emitted, and an ion puller electrode to pull out ions from the ion source cone through the ion outlet by applying a voltage between the ion source and the ion puller electrode, the ion puller electrode having a sliding aperture member provided with an aperture which can be positioned opposite to the ion outlet of the ion source cone and capable of sliding relative to the dee, the ion source cone being in contact with the aperture member and being movable in a sliding direction of the aperture member, said method comprising steps of:

bringing the ion source cone into contact with the aperture member;

moving the ion source cone until the aperture member slides on the dee to a desired position; and moving the ion source cone to a position where the ion outlet of the ion source cone is opposite to the aperture of the aperture member.

* * * * *